United States Patent [19]

Hopper, Sr. et al.

[11] Patent Number: 5,029,550

[45] Date of Patent: Jul. 9, 1991

[54] HYDRANT TAG STRUCTURE

[76] Inventors: Richard L. Hopper, Sr., 9302 Stephen Richards Dr., Juneau, Ak. 99801; Eli A. Mikos, Rt. 2, Box 2217, Manistique, Mich. 49854

[21] Appl. No.: 619,524

[22] Filed: Nov. 29, 1990

[51] Int. Cl.[5] ..... G09F 7/00

[52] U.S. Cl. ..... 116/209; 206/214

[58] Field of Search ..... 116/209; 40/299, 331, 40/333, 584, 642, 645, 655, 665, 649, 647, 316; 206/214, 573, 580, 806; 224/257, 277, DIG. 907; 292/307 R, 307 A, 318, 319, 321; 137/272; 24/16 PB

[56] References Cited

U.S. PATENT DOCUMENTS

| | | | |
|---|---|---|---|
| 1,952,085 | 3/1934 | Mayer | 40/665 |
| 4,456,126 | 6/1984 | Hicks, Jr. | 206/573 |
| 4,506,415 | 3/1985 | Swift | 24/16 PB |
| 4,562,047 | 12/1985 | Sestak et al. | 422/300 |
| 4,570,368 | 2/1986 | Stover | 24/16 PB |
| 4,602,654 | 7/1986 | Stehling et al. | 137/296 |

FOREIGN PATENT DOCUMENTS

| | | | |
|---|---|---|---|
| 0943031 | 2/1949 | France | 40/645 |

*Primary Examiner*—William A. Cuchlinski, Jr.
*Assistant Examiner*—W. Morris Worth
*Attorney, Agent, or Firm*—Leon Gilden

[57] ABSTRACT

Apparatus to enable selective securement to various fire type hydrants is present to provide visual indication of flow characteristics of an associated hydrant wherein the tag structure is color coded and permits ease of securement to an associated hydrant conduit. The invention is formeed of a plate like member utilizing a flexible securement loop mounted to an upper end of the structure with the member including a concave recess to accommodate a hydrant therewithin. Modifications of the invention may include a cabinet type structure formed with a rear and forward container mounting a selective tag within the forward container and various writing implements for use with the organization in the rear container.

8 Claims, 4 Drawing Sheets

HYDRANT TAG STRUCTURE

BACKGROUND OF THE INVENTION

1. Field of the Invention

The field of the invention relates to hydrant type structure, and more particularly pertains to a new and improved hydrant tag structure wherein the same permits visual identification of associated fire hydrants to indicate flow characteristics and number of each such hydrant.

2. Description of the Prior Art

Municipalities and private water companies in assessing various flow characteristics of various hydrants utilize a time consuming painting and color coding of such hydrants typically to effect indication of various flow characteristics and numbering of each respective hydrant. This time consuming operation minimizes efficiency in proper color coding of such hydrant structure.

The instant invention attempts to overcome deficiencies of the prior art by providing a convenient and readily securable tagging structure that is readily mounted and removed from an associated hydrant in a tamper proof configuration. Prior art structure may be found in U.S. Pat. No. 4,478,169 to SHREFLER wherein a marking device is provided for locating a fire hydrant and the like that may be concealed by various environmental characteristics such as snow, vegetation and the like. The structure includes a signal antenna mounted to an associated hydrant.

U.S. Pat. No. 3,044,435 to REARDON utilizes a further hydrant marking organization utilizing a flag mounted to a spring base for indicating position of an associated fire hydrant.

U.S. Pat. No. 3,495,568 to PALINKOS sets forth a pennant for mounting to poles and the like for providing indication of an associated vehicle.

U.S. Pat. No. 3,141,253 to BARTRAM utilizes a signal device mounted to a dash board of a vehicle for providing pedestrians with a vehicle driver's intention as to the vehicles intended movement or stationary positioning relative to pedestrians.

Accordingly a new and improved hydrant tag structure as set forth by the instant invention addressing both the problems of ease of use as well as effectiveness in construction in providing visual assessment of a hydrant flow characteristics and number is provided and as such the present invention substantially fulfills this need.

SUMMARY OF THE INVENTION

In view of the foregoing disadvantages inherent in the known types of hydrant marking structure present in the prior art, the present invention provides a new and improved hydrant tag structure wherein the same is readily securable to an associated hydrant to effect visual indication of a hydrant flow characteristics. As such, the general purpose of the present invention, which will be described subsequently in greater detail, is to provide a new and improved hydrant tag structure which has all the advantages of the prior art hydrant indicator structure and none of the disadvantages.

To attain this, the hydrant tag structure of the instant invention includes apparatus to enable selective securement to various fire type hydrants is presented to provide visual indication of flow characteristics and numbering of an associated hydrant wherein the tag structure is color coded and permits ease of securement to an associated hydrant conduit. The invention is formed of a plate like member utilizing a flexible securement loop mounted to an upper end of the structure with the member including a concave recess to accommodate a hydrant therewithin. Modifications of the invention may include a cabinet type structure formed with a rear and forward container mounting a selective tag within the forward container and various writing implements for use with the organization in the rear container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hydrant tag structure which has all the advantages of the prior art hydrant tag structure and none of the disadvantages.

It is another object of the present invention to provide a new and improved hydrant tag structure which may be easily and efficiently manufactured and marketed.

It is a further object of the present invention to provide a new and improved hydrant tag structure which is of a durable and reliable construction.

An even further object of the present invention is to provide a new and improved hydrant tag structure which is susceptible of a low cost of manufacture with regard to both materials and labor, and which accordingly is then susceptible of low prices of sale to the consuming public, thereby making such hydrant tag structure economically available to the buying public.

Still yet another object of the present invention is to provide a new and improved hydrant tag structure which provides in the apparatuses and methods of the prior art some of the advantages thereof, while simultaneously overcoming some of the disadvantages normally associated therewith.

Still another object of the present invention is to provide a new and improved hydrant tag structure which may be compactly stored when not being utilized.

Yet another object of the present invention is to provide a new and improved hydrant tag structure utilizing a flexible band and associated indicator plate for selective securement to a fire hydrant to present visual indication of a fire hydrant's flow characteristics and number.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
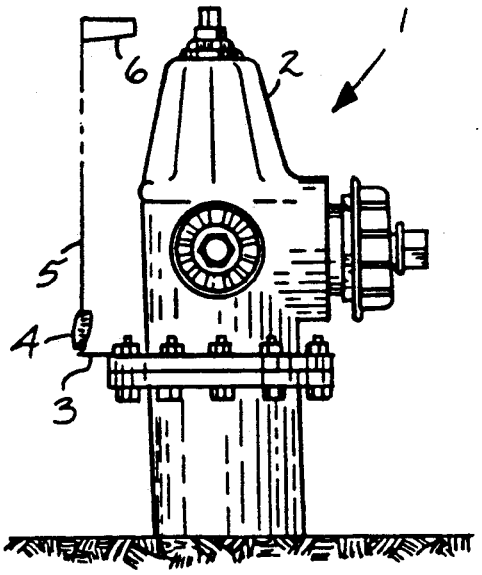
FIG. 1 is an orthographic view taken in elevation of a prior art hydrant marking type structure.

With reference now to the drawings, and in particular to FIGS. 1 to 6 thereof, a new and improved hydrant tag structure embodying the principles and concepts of the present invention and generally designated by the reference numeral 10 will be described.

FIG. 1 illustrates a prior art hydrant marking structure 1 wherein a fire hydrant member 2 as mounted thereto a plate member 3 supporting a spring base 4 mounting a pole member 5 and an indicator flag 6 mounted at an upper end of the pole member wherein typically the flag or pennant 6 extends above the associated fire hydrant for providing physical positioning of the fire hydrant within an associated geographic environment.

Figure 2:
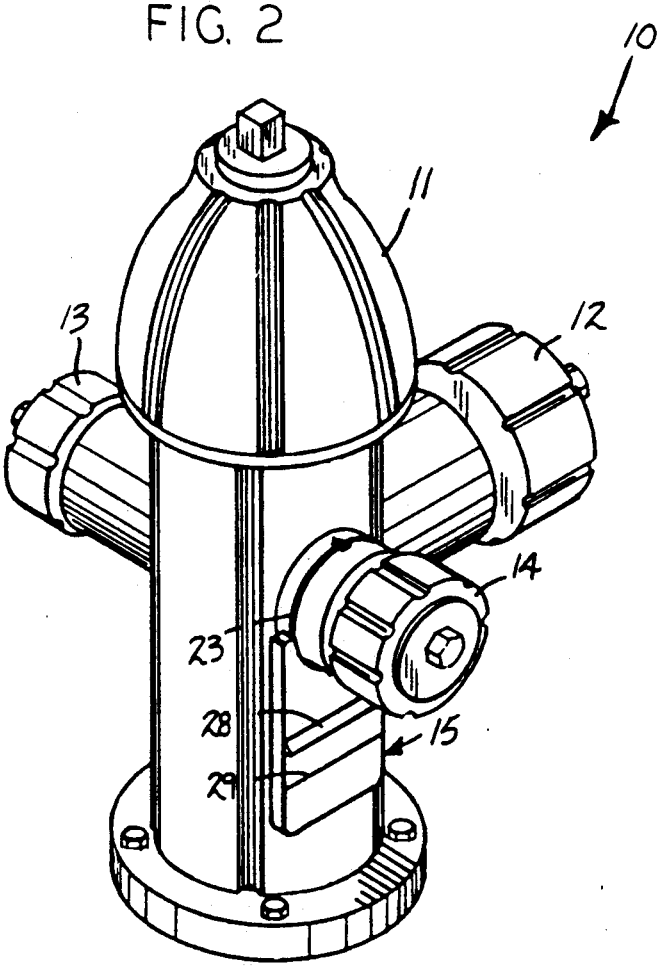
PRIOR ART FIG. 2
FIG. 2 is an isometric illustration of the instant invention in association with a fire hydrant.
Figure 3:
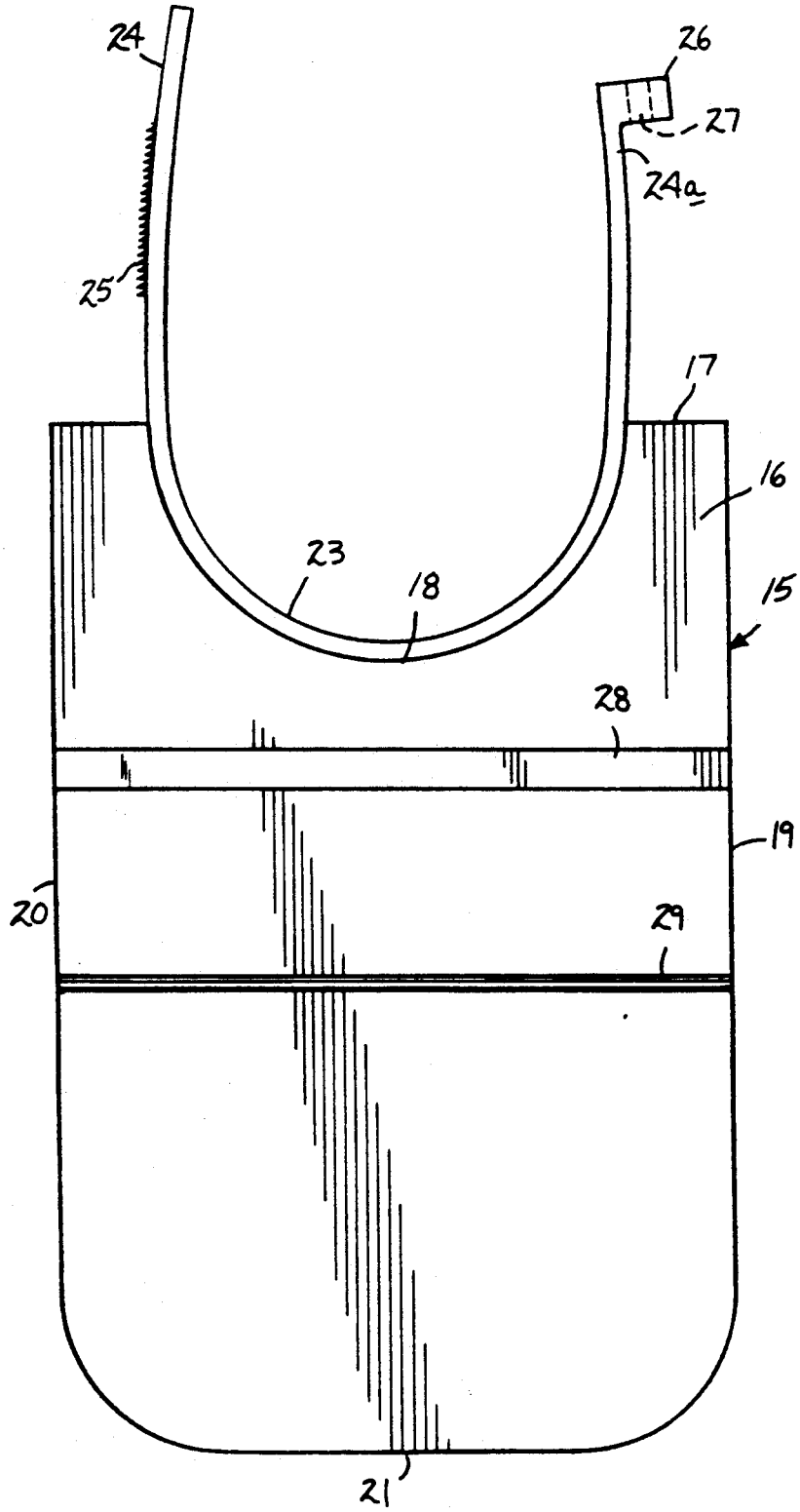
FIG. 3 is an orthographic frontal view taken in elevation of the instant invention.
Figure 4:
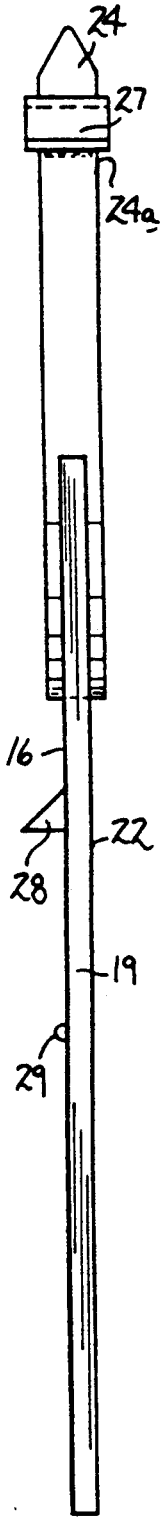
FIG. 4 is an orthographic side view of the instant invention taken in elevation.

More specifically, the hydrant tag structure of the instant invention essentially comprises water hydrant 11 including a large hose connector 12 and a first and second small hose connectors 13 and 14 respectively. The tag structure further includes a tag member body 15 formed of a flexible memory retentent material typically of a polymeric type plastic including a forward surface 16 and a rear surface 22. The body 15 includes a top edge 17 spaced from a bottom edge 21 with a right side edge 19 spaced from a left side edge 20. A semi-annular recess 18 projects medially and interiorly of the body originating from the top edge 17. A flexible securement yoke 23 of a finite length greater than the predetermined length defined by the annular recess 18 is bonded or molded thereto. The securement yoke 23 includes a first free end portion 24 and a second free end portion **24*a*. The first end portion 24 includes a series of aligned engagement teeth 25 defined by a predetermined height receivable within a fastener head 26 integrally mounted to a terminal end of the second end portion 24*a* wherein the fastener head 26 includes a through extending bore 27 defined by a width less than the predetermined height of the engagement teeth 25 to secure the engagement teeth within the fastener head 26 when the first end portion 24 is directed therethrough in a manner as illustrated in FIG. 2. The forward surface 16 includes an alignment bead 29 extending between the right side edge 19 and the left side edge 20 and arranged orthogonally thereto to align positioning of indicia to be presented thereon which indicia are characteristic of each associated hydrant member 11. The alignment bead 29 accordingly positions and aligns such indicia with an overlying rain diverting projection 28 arranged parallel to and spaced above the alignment bead 29 with the rain diverting projection 28 terminating in a forward edge extending beyond the alignment bead 29 to effect diverting of rain thereon utilizing a sloping surface directed from the forward surface downwardly to the forward edge of the projection 28**.

Figure 5:
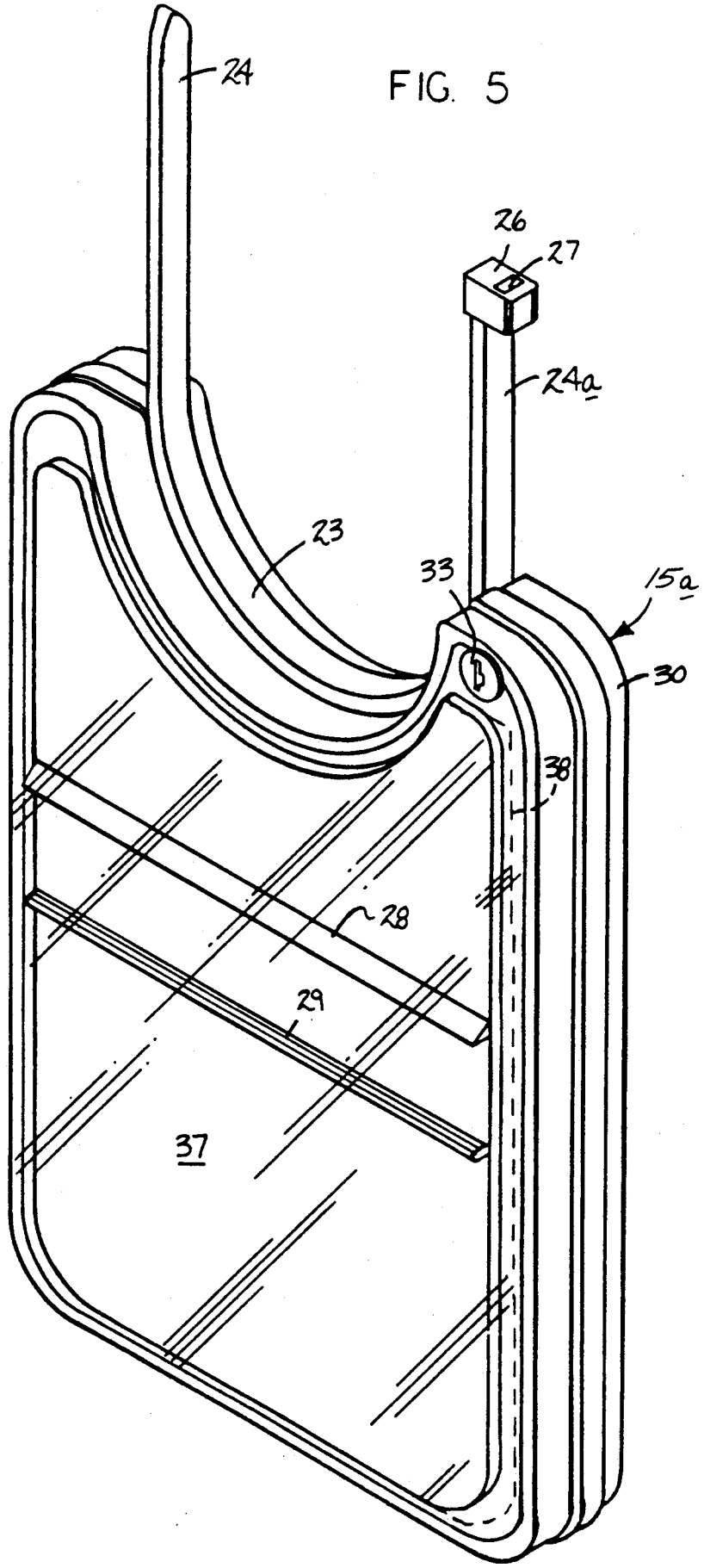
FIG. 5 is an isometric illustration of a modified construction of the instant invention.
Figure 6:
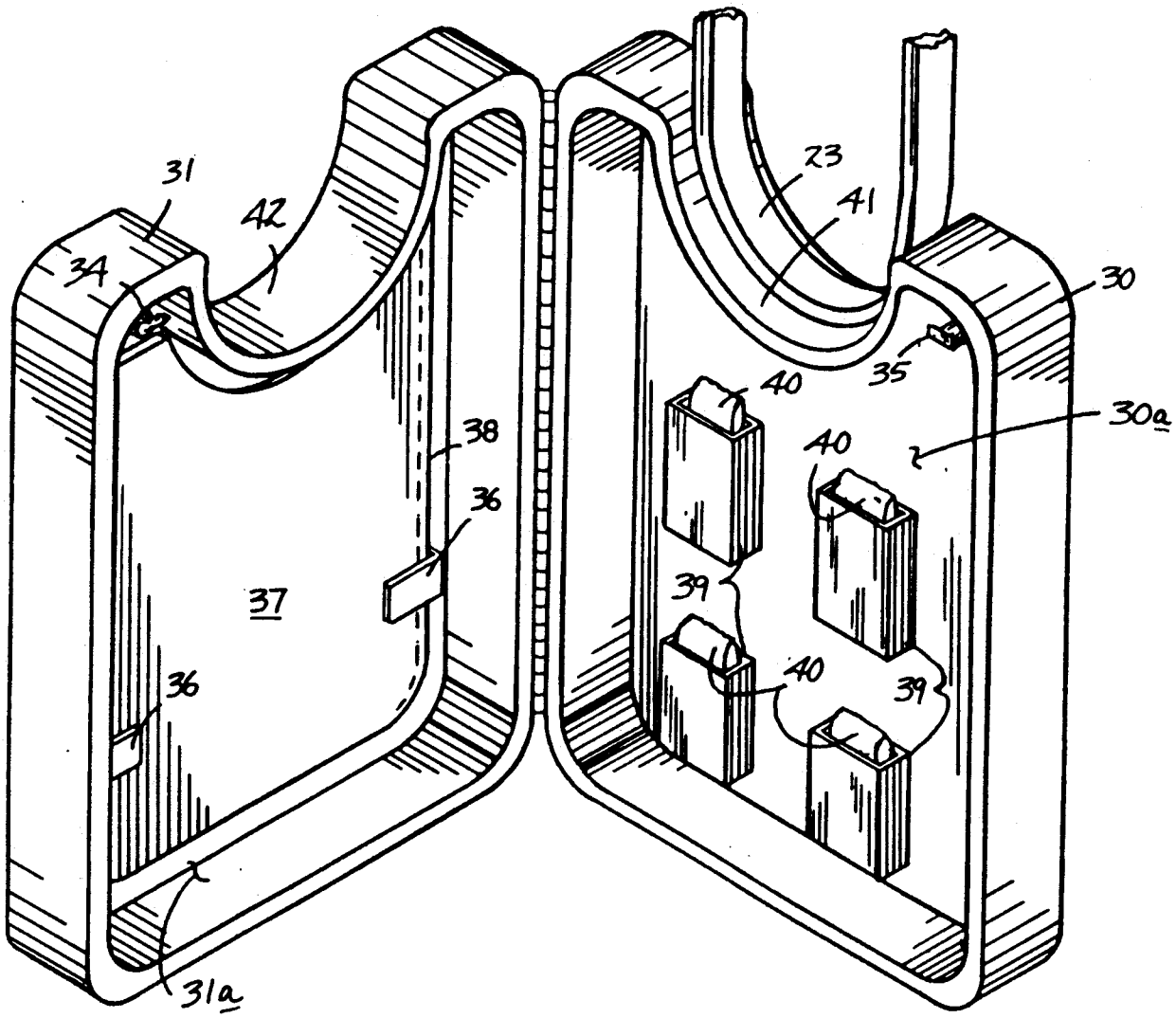
FIG. 6 is an isometric illustration of the modified structure in an open configuration.

FIGS. 5 and 6 illustrate a modified tag member body **15*a* including a rear container 30 hingedly mounted to a forward container 31 wherein the rear and forward containers are of complementary configuration relative to one another wherein the rear container 30 includes a rear compartment 30*a* cooperative with a forward compartment 31*a* of the forward container 31. A cover strip 32 typically of an adhesive material effects sealing of the forward and rear compartments together with a lock member 33 providing selective access within the rear and forward containers when directed to an open position as illustrated in FIG. 6 for example. An elongate hinge mounts the forward and rear compartments together at cooperating sides thereof wherein the lock member 33 includes a lock member flange 34 cooperating with a securement flange 35 to selectively secure the forward and rear compartments together as illustrated in FIGS. 5 and 6. The rear compartment includes a rear semi-cylindrical recess 41 mounting the flexible securement yoke 23 therewithin in a like manner as noted for the discussion of the tag member body 15. The rear semi-cylindrical recess 41 cooperative to the forward semi-cylindrical recess 42 of the forward compartment to accommodate as associated hose connection of the hydrant member 11 wherein the rear and forward semi-cylindrical recesses 41 and 42** are coaxially aligned relative to one another and depend downwardly from a top edge portion of each forward and rear container as illustrated.

Spaced L-shaped securement flanges 36 are mounted within the forward compartment **31*a* to secure an indicator panel 37 therewithin. The indicator panel 37 is directed through an opening formed within the forward wall of the forward compartment wherein the indicator panel 37 includes indicator panel side flanges 38 mounted to each side of the indicator panel 37 to permit the indicator panel 37 body to project through the opening of the forward wall of the forward compartment wherein the side flanges 38 cooperate with the forward wall portion of the forward compartment to retain the indicator panel 37 therewithin. And in this manner, various indicator panels 38 may be positioned within the forward compartment for visual observation of various flow characteristics of each associated hydrant. Further, the rear compartment 30*a* includes a series of spaced containers 39 each including a writing instrument 40 of a water insoluble component for writing specific indication of flow characteristics between the rain diverting projection 28 and the underlying alignment bead 29 of the indicator panel 37**.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A hydrant tag structure in combination with a water hydrant member, the water hydrant member including at least one hose connection, and wherein the tag structure includes a tag member body, the tag member body including a flexible securement yoke mounted to an upper end of the tag member body, and the tag member body including a forward surface wherein the forward surface includes an alignment bead projecting forwardly of the forward surface for alignment of indicia positioned above the alignment bead, and a rain diverting projection spaced above and parallel to the alignment bead wherein the rain diverting projection projects beyond the alignment bead to enhance deflection of water beyond a portion of the forward surface between the alignment bead and the rain diverting projection.

2. A hydrant tag structure as set forth in claim 1 wherein the tag member body is formed of a flexible memory retentent polymeric material.

3. A hydrant tag structure as set forth in claim 2 wherein the upper end of the tag member body includes a semi-annular recess wherein the flexible securement yoke is fixedly mounted circumferentially within the semi-annular recess and wherein the securement yoke includes a first free end and a second free end each projecting outwardly of the semi-annular recess wherein the first free end includes a series of engagement teeth defined by a predetermined height mounted to the first free end with the second free end including a fastener head and integrally mounted to the second free end with the fastener head including a through extending bore defining a width substantially less than the predetermined height to secure the first free end within the second free end wherein the second free end is directed through the fastener head.

4. A hydrant tag structure as set forth in claim 3 wherein the tag member body includes a rear container hingedly mounted to a forward container utilizing a hinge member mounted therebetween wherein the rear and forward containers each include a respective rear and forward compartment wherein the rear and forward compartments are of a complementary configuration relative to one another, and the forward container includes a lock member wherein the lock member is cooperative with a securement flange wherein the securement flange is integrally mounted within the rear compartment to selectively secure the rear container to the forward container.

5. A hydrant tag structure as set forth in claim 4 wherein the forward compartment includes the forward surface, the forward surface includes an opening directed therethrough wherein the opening includes an indicator panel, the indicator panel including the alignment bead a rain diverting projection mounted thereon, and the forward compartment includes a plurality of spaced L-shaped flanges mounted within the forward compartment to secure the indicator panel in alignment with the opening, the indicator panel including spaced side flanges extending beyond the opening to align and mount the indicator panel within the forward compartment.

6. A hydrant tag structure as set forth in claim 5 wherein the semi-cylindrical recess includes a rear semi-cylindrical recess and a forward semi-cylindrical recess, the rear semi-cylindrical recess projecting downwardly from an upper end of the rear container and the forward semi-cylindrical recess coaxially aligned with the rear semi-cylindrical recess when the forward inner compartments are secured together.

7. A hydrant tag structure as set forth in claim 6 wherein the rear compartment includes a plurality of spaced containers mounted therewithin, each spaced container including a writing instrument formed of a water insoluble writing composition to permit selective imparting of indicia between the rain diverting projection and the alignment bead.

8. A hydrant tag structure as set forth in claim 7 wherein the rain diverting projection includes a sloping surface directed towards a forward edge, the forward edge projecting beyond the alignment bead, and the forward edge arranged parallel to the alignment bead.

* * * * *